US006963790B2

(12) United States Patent
Mizuno et al.

(10) Patent No.: US 6,963,790 B2
(45) Date of Patent: Nov. 8, 2005

(54) EMBROIDERY DATA PRODUCING DEVICE AND EMBROIDERY DATA PRODUCING PROGRAM STORED ON A COMPUTER-READABLE MEDIUM

(75) Inventors: Masahiro Mizuno, Nagoya (JP); Mikitoshi Suzuki, Nagoya (JP); Shoichi Taguchi, Nagoya (JP); Yukiyoshi Muto, Nagoya (JP); Akihiro Wakayama, Nagoya (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 18 days.

(21) Appl. No.: 11/015,664

(22) Filed: Dec. 20, 2004

(65) Prior Publication Data

US 2005/0165506 A1 Jul. 28, 2005

(30) Foreign Application Priority Data

Jan. 28, 2004 (JP) ..... 2004-019837

(51) Int. Cl.[7] ..... G06F 19/00
(52) U.S. Cl. ..... 700/138; 112/102.5; 112/470.04
(58) Field of Search ..... 700/138, 136, 700/137; 112/102.5, 470.06, 475.19, 470.04

(56) References Cited

U.S. PATENT DOCUMENTS

| | | | | |
|---|---|---|---|---|
| 5,299,514 A | | 4/1994 | Hayakawa et al. | |
| 5,823,127 A | | 10/1998 | Mizuno | |
| 5,875,725 A | | 3/1999 | Mizuno | |
| 5,899,154 A | * | 5/1999 | Mizuno | 112/102.5 |
| 5,934,209 A | * | 8/1999 | Mizuno | 112/102.5 |
| 5,957,068 A | | 9/1999 | Mizuno | |

FOREIGN PATENT DOCUMENTS

JP A 11-90069 4/1999

* cited by examiner

*Primary Examiner*—Peter Nerbun
(74) *Attorney, Agent, or Firm*—Oliff & Berridge PLC

(57) ABSTRACT

An embroidery data producing device includes an offset line producing device for producing data of an offset line obtained by offsetting an outline defining an embroidery area inside an embroidery area by a previously set offset width, based on data of the outline defining the embroidery area, a self-intersection or mutual intersection detecting device for detecting a self-intersection of the offset line produced by the offset line producing device or a mutual intersection of the offset line and the outline, and an offset line changing device for changing the offset line data produced by the offset line producing device upon detection of a self-intersection or mutual intersection by the self-intersection or mutual intersection detecting device so that the self-intersection or the mutual intersection is dissolved.

22 Claims, 10 Drawing Sheets

EMBROIDERY DATA PRODUCING DEVICE AND EMBROIDERY DATA PRODUCING PROGRAM STORED ON A COMPUTER-READABLE MEDIUM

BACKGROUND OF THE INVENTION

1. Field of the Invention

This invention relates to an embroidery data producing device and embroidery data producing program, and more particularly to such an embroidery data producing device and program capable of producing data of offset line formed by moving an outline defining an embroidery area inside the embroidery area.

2. Description of the Related Art

It is generally known that underlying stitches are sewn under embroidery stitches with a lower thread density than the embroidery stitches when a part of work cloth inside an outline is filled with the embroidery stitches so that an embroidery pattern is sewn. The underlying stitches sewing is carried out in order to provide a three-dimensional effect on the lock stitches sewn over them or in order to prevent the work cloth from shrinking during the lock stitch sewing, thereby improving sewing quality.

Data of the aforesaid underlying stitch sewing is generally produced by an embroidery data producing device. The embroidery data producing device produces data of offset line obtained by moving an outline defining an embroidery area inside by a predetermined offset width (1 mm, for example). A plurality of needle points for underlying stitch are formed on the produced offset line. The needle points for underlying stitch are sequentially connected zigzag to one another so that underlying stitch sewing data is produced. An embroidering and sewing machine carries out an underlying stitch sewing based on the produced underlying stitch sewing data.

On the other hand, when embroidering and sewing is to be executed in a set sewing order, an inside running stitch sewing is sometimes carried out in order that a needle location may be moved to a predetermined sewing start location. The inside running stitches are sewn over the offset line formed near the outline so as to be inconspicuous even when the thread density for embroidery stitch is low.

Furthermore, when an appliqué cloth piece is sewn onto work cloth in appliqué sewing, data of offset line inside an outline of the appliqué cloth piece is produced. The appliqué cloth piece is sewn onto work cloth on the basis of the produced data.

The above-described offset lines are produced so as to be moved by the offset width inward from the outline defining the embroidery area. Accordingly, when two opposed outlines include respective portions coming close to each other, a part of a continuous offset line intersects another part of the offset line (referred to as "self-intersection") or an offset line and outline intersect each other (referred to as mutual intersection"). Improving the sewing quality is difficult when underlying stitch sewing, inside running stitch sewing or other stitch sewing related to appliqué is carried out on the basis of the aforesaid offset line data.

U.S. Pat. No. 5,823,127 assigned to the same assignee as the present application discloses an embroidery data processing apparatus which is provided for an embroidery machine and is capable of producing underlying stitch data even when an offset line self-intersects. The disclosed embroidery data processing apparatus divides an underlying stitch area into a plurality of partial underlying stitch sewing areas encompassed by the offset line with the self-intersection point serving as a boundary point when the produced offset line has self-intersected. Furthermore, regarding each partial underlying stitch sewing area, whether an offset point is located inside the outline is determined. Data of auxiliary underlying stitch sewing is produced for the partial underlying stitch sewing area in which even at least one offset point is located outside the outline. On the other hand, partial underlying stitch sewing data is produced in a usual manner regarding each partial underlying stitch sewing area in which all the offset points are located inside the outline.

When the auxiliary underlying stitch sewing data is produced, the embroidery data processing apparatus extends a straight line obtained by connecting an offset point located between two self-intersection points and an apex of the outline. The apparatus then obtains a point of intersection at which the straight line and the outline intersect each other. The apparatus further obtains a middle point between the point of intersection and the apex of the outline and sequentially connects the self-intersection point and all the middle points, thereby producing data of running stitch sewing. The produced running stitch sewing data is used as auxiliary underlying stitch sewing data.

However, the above-described embroidery data processing apparatus does not dissolve the self intersection itself. Accordingly, the control of calculation for production of embroidery data is rendered complicated since a plurality of partial underlying stitch sewing data need to be produced for the underlying stitch sewing area. Particularly when the auxiliary underlying stitch sewing data is produced for the area between the self intersection points, the embroidery data processing apparatus is required to calculate the straight line between the offset point and the apex, the intersection point between the straight line and the outline, and the middle point between the intersection point and the apex. Thus, complicated calculation control is required. Furthermore, the calculation control is also complicated when the aforesaid technique is applied to production of an offset line for inside running stitch sewing and appliqué stitch sewing.

Furthermore, the aforesaid auxiliary underlying stitch sewing is substantially straight running stitch sewing. Accordingly, when the auxiliary underlying stitch sewing is used as the underlying stitch sewing, proper effects of underlying stitch sewing cannot sometimes be achieved sufficiently in the respects of the strength in the area of work cloth to which the auxiliary underlying stitch sewing has been applied, the shrinkage in the work cloth during embroidery stitch sewing, the three-dimensional effect of the embroidery pattern in the embroidery area and the like.

Yet furthermore, the foregoing technique is difficult to apply to production of data for appliqué stitch sewing in the case where an appliqué cloth piece is sewn along an offset line offset inside an outline of the appliqué cloth piece by a predetermined width. The reason for this is that two portions sewn by the appliqué stitch sewing are overlapped in the narrow area when the appliqué stitch sewing is carried out using auxiliary underlying stitch sewing data in a narrow area of the appliqué cloth piece.

SUMMARY OF THE INVENTION

Therefore, an object of the present invention is to provide an embroidery data producing device and an embroidery data producing program which can dissolve the self intersection of the offset line or mutual intersection of the offset line and outline such that the control of calculation for production of embroidery data can be simplified.

The present invention provides an embroidery data producing device comprising offset line producing means for producing data of an offset line obtained by offsetting an outline defining an embroidery area inside an embroidery area by a previously set offset width, based on data of the outline defining the embroidery area, self-intersection detecting means for detecting a self-intersection of the offset line produced by the offset line producing means, and offset line changing means for changing the offset line data produced by the offset line producing means upon detection of a self-intersection by the self-intersection detecting means so that the self-intersection is dissolved.

When the self-intersection of offset line has been detected, the offset line is changed so that the self intersection is dissolved. Embroidery data is produced using the offset line having no self intersection. Consequently, the embroidery data can be produced by a normal calculation control processing without self intersection in the process subsequent to completion of offset line data and accordingly, the control of calculation for production of embroidery data can be simplified.

The invention also provides an embroidery data producing device comprising offset line producing means for producing data of an offset line obtained by offsetting an outline defining an embroidery area inside an embroidery area by a previously set offset width, based on data of the outline defining the embroidery area, mutual intersection detecting means for detecting a mutual intersection of the offset line produced by the offset line producing means and the outline, and offset line changing means for changing the offset line data produced by the offset line producing means upon detection of a mutual intersection by the mutual intersection detecting means so that the mutual intersection is dissolved.

When the mutual intersection of offset line and outline has been detected, the offset line is changed so that the mutual intersection is dissolved. Embroidery data is produced using the offset line having no mutual intersection. Consequently, the embroidery data can be produced by a normal calculation control processing without mutual intersection in the process subsequent to completion of offset line data and accordingly, the control of calculation for production of embroidery data can be simplified.

BRIEF DESCRIPTION OF THE DRAWINGS

Other objects, features and advantages of the present invention will become clear upon reviewing the following description of embodiments with reference to the accompanying drawings, in which.

DETAILED DESCRIPTION OF THE INVENTION

Figure 1:
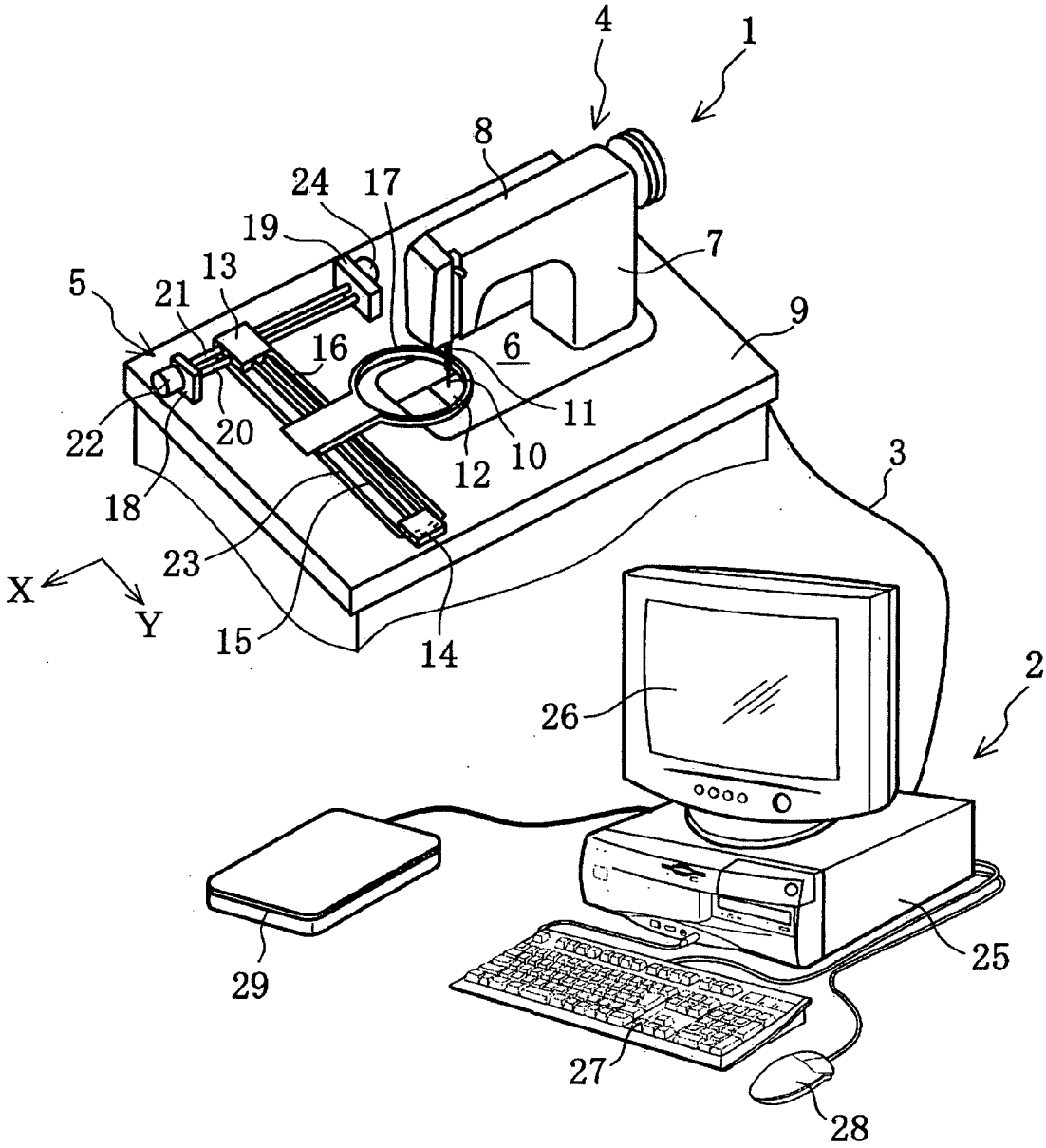
FIG. 1 is a perspective view of an embroidering and sewing machine and an embroidery data producing device in accordance with a first embodiment of the present invention.

A first embodiment of the present invention will be described with FIGS. 1 to 5C. The invention is applied to an embroidery data producing device for producing embroidery data including underlying stitch sewing data. Referring to FIG. 1, an embroidering and sewing machine 1 and an embroidery data producing device 2 are shown. The embroidering and sewing machine 1 is connected via a data transfer cable 3 to the embroidery data producing device 2.

The construction of the embroidery and sewing machine 1 will be described in brief. The embroidering and sewing machine 1 comprises a sewing machine body 4 and an embroidery frame moving mechanism 5 for moving an embroidery frame 17 right and left or in the X-direction and back and forth or in the Y-direction. The sewing machine body 4 includes a sewing bed 6, a sewing pillar 7 standing at a right end of the bed 6 and a sewing arm 8 extending leftward from an upper end of the pillar 7 so as to be opposed to the bed 6. The body 4 is installed on a sewing machine table 9 with the bed 6 being assembled into the table. The arm 8 has at its left end an arm head provided with a needle bar 11 to which a sewing needle 10 is attached. The needle bar 11 is moved up and down by a needle bar driving mechanism (not shown). A shuttle mechanism (not shown) is provided below a needle plate 12 and driven in synchronization with the up-and-down movement of the needle bar 11.

The embroidery frame moving mechanism 5 will now be described in detail. Referring to FIG. 1, the sewing table 9 is provided with right and left brackets 18 and 19 spaced from each other. A lead shaft 20 and a transmission shaft 21 are rotatably supported by the brackets 18 and 19. A moving member 13 is in threading engagement with the lead shaft 20 so as to be moved in the X-direction with rotation of the lead shaft 20. Two guide rods 15 and 16 are mounted on the moving member 13 so as to extend back and forth in parallel to each other. Another moving member 14 is fixed to the distal ends of the guide rods 15 and 16. The embroidery frame holding work cloth has a left end which is coupled to the guide rods 15 and 16 so as to be movable in the Y-direction. A wire 23 extends between the moving members 13 and 14. The left end of the embroidery frame 17 is connected to the wire 23.

The lead shaft 20 is rotated by an X-axis drive motor 22. Upon rotation of the lead shaft 20, the moving member 13 in engagement with the lead shaft 20 is moved in the X-axis direction. The embroidery frame 17 coupled to the moving member 13 by the guide rods 15 and 16 is also moved in the X-axis direction with the moving member 13. On the other hand, the transmission shaft 21 is rotated by a Y-axis drive motor 24. Upon rotation of the transmission shaft 21, the embroidery frame 17 is moved via a wire 23 in the Y-axis direction.

In the embroidering and sewing machine 1, on the basis of embroidery data produced by the embroidery data producing device 2, the embroidery frame 17 is moved in the X-axis and Y-axis directions by the X-axis and Y-axis drive motors 22 and 24 so that work cloth is moved in the X-axis and Y-axis directions, whereby embroidery sewing is carried out.

The embroidery data producing device 2 will now be described. Based on data of an outline defining an embroidery area, the embroidery data producing device 2 produces data of an offset line obtained by offsetting or moving the outline inside the embroidery area by a set offset width. When offset lines intersect (self-intersection), the offset line data is changed so that the self-intersection is dissolved and data of underlying stitch sewing is produced on the basis of the changed offset line.

Figure 2:
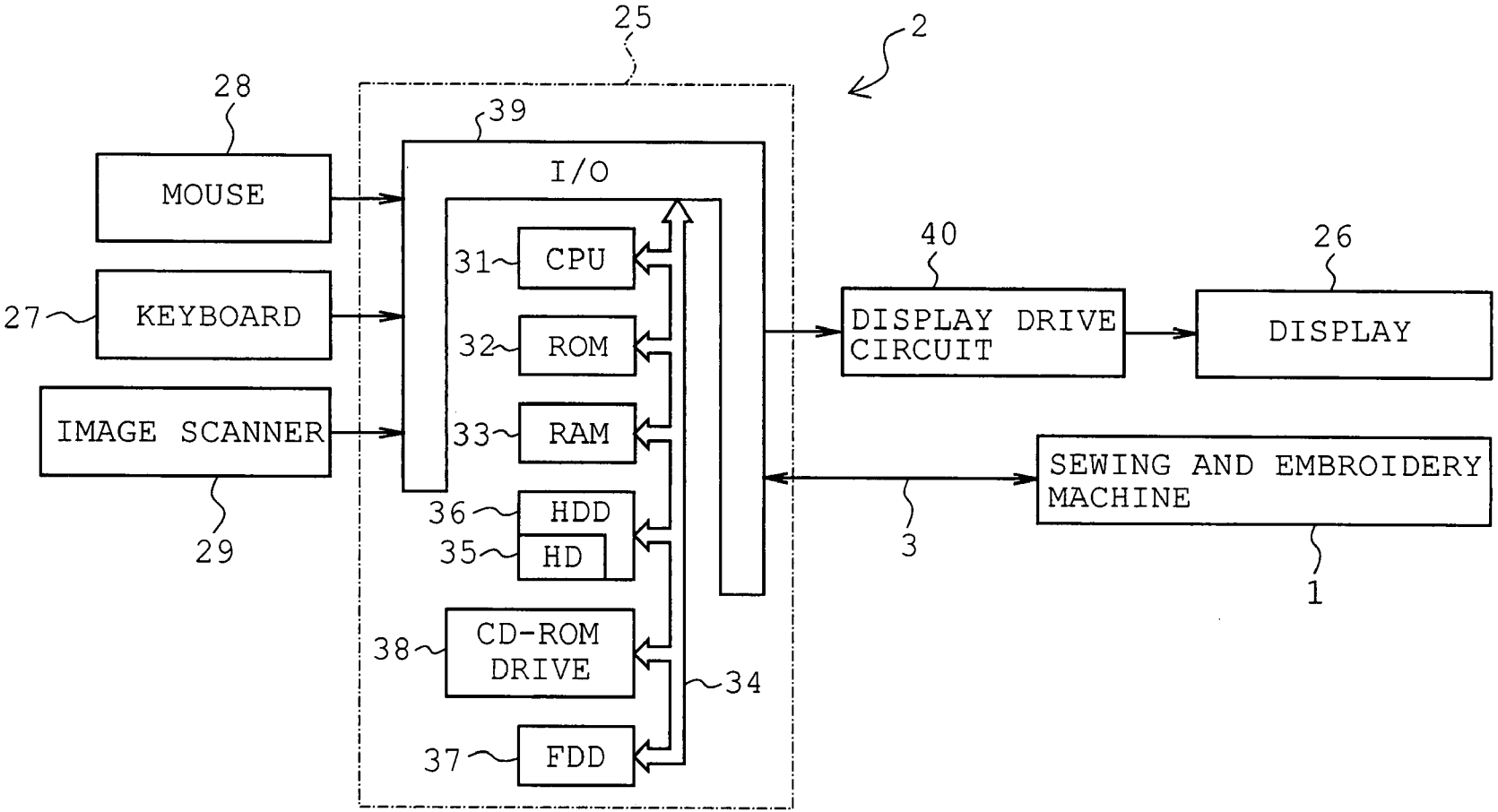
FIG. 2 is a block diagram showing an electrical arrangement of the control system of the embroidery data producing device.
Figure 5A:
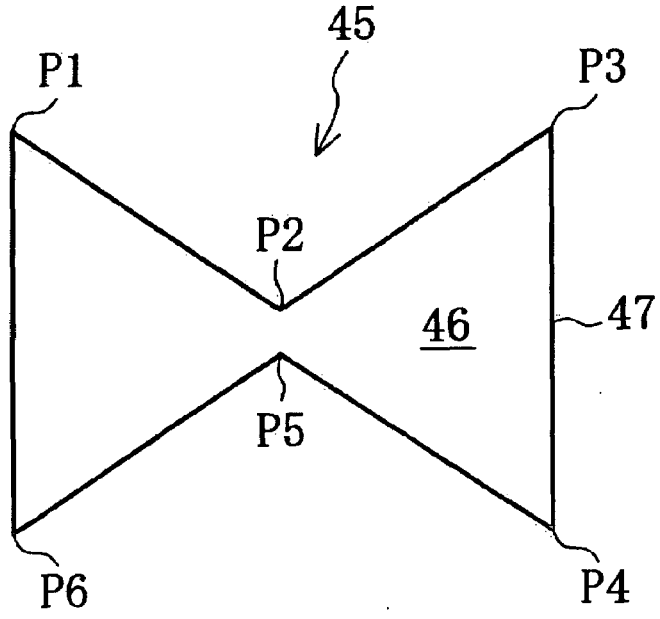
FIG. 5A shows an outline of an embroidery pattern.

FIG. 2 shows an electrical arrangement of the control system of the embroidery data producing device. The embroidery data producing device 2 comprises a personal computer 25 which will hereinafter be referred to as "PC 25," a display 26, a keyboard 27, a mouse 28 and an image scanner 29. When an embroidery pattern 45 as shown in FIG. 5A is to be sewn, an original picture of the embroidery pattern 45 is read in by the image scanner 29. The embroidery data producing device 2 then obtains data of an outline 47 defining an embroidery area 46 of the embroidery pattern 45.

PC 25 manages the whole control about the production of embroidery data. PC 25 includes a microcomputer further including CPU 31, ROM 32, RAM 33 and buses 34 connecting the former devices. PC 25 further includes a hard disc drive (HDD) 36 provided with a hard disc (HD) 35 connected to the bus 34. PC 25 yet further includes an input/output interface 39 and the like. A flexible disc drive (FDD) 37 and a CD-ROM drive 38 are also connected to the bus 34. Furthermore, to the input/output interface 39 are connected the embroidering and sewing machine 1, a display drive circuit 40 for connecting the display 26, the keyboard 27, the mouse 28, the image scanner 29 and the like.

ROM 32 stores a start-up program to start up the PC 25 upon power-on thereof etc. HD 35 stores an operating system (OS), drivers for rendering the display 26, keyboard 27, mouse 28, image scanner 29 and the like usable respectively and various programs such as an embroidery data producing program which will be described later. Furthermore, HD 35 also stores input image data read in by the image scanner 29, embroidery data of the embroidery pattern 45 produced on the embroidery data producing program and the like.

Figure 3:
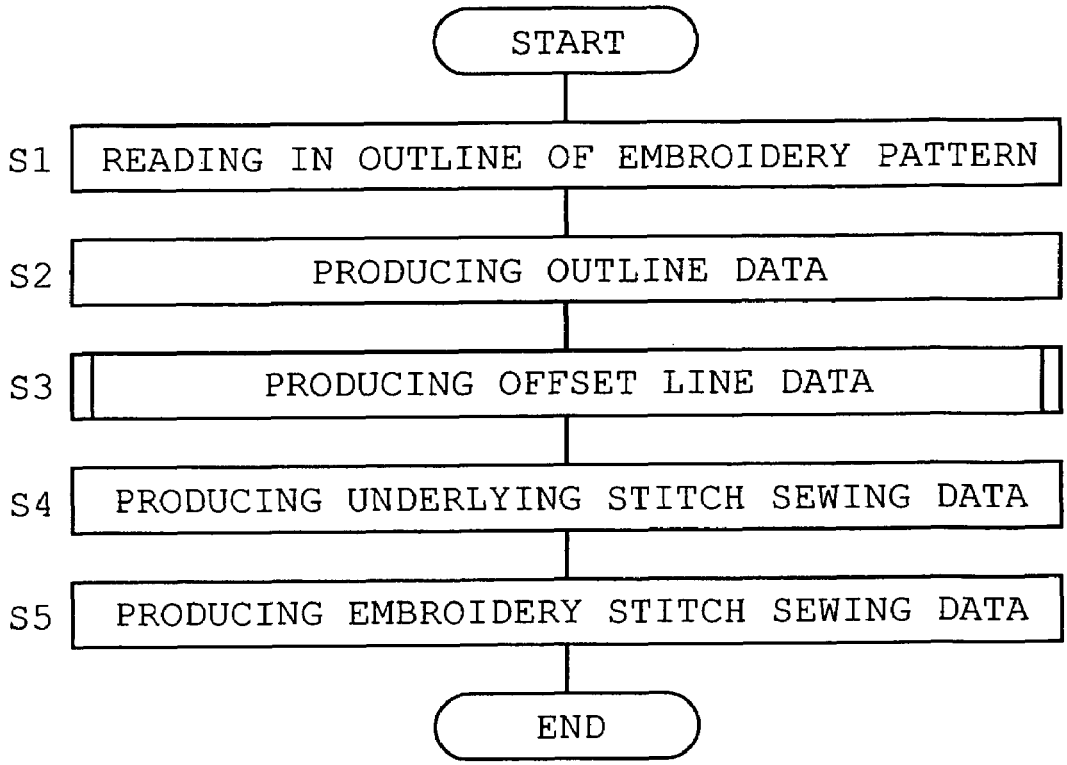
FIG. 3 is a flowchart showing a main routine of an embroidery data producing program.
Figure 4:
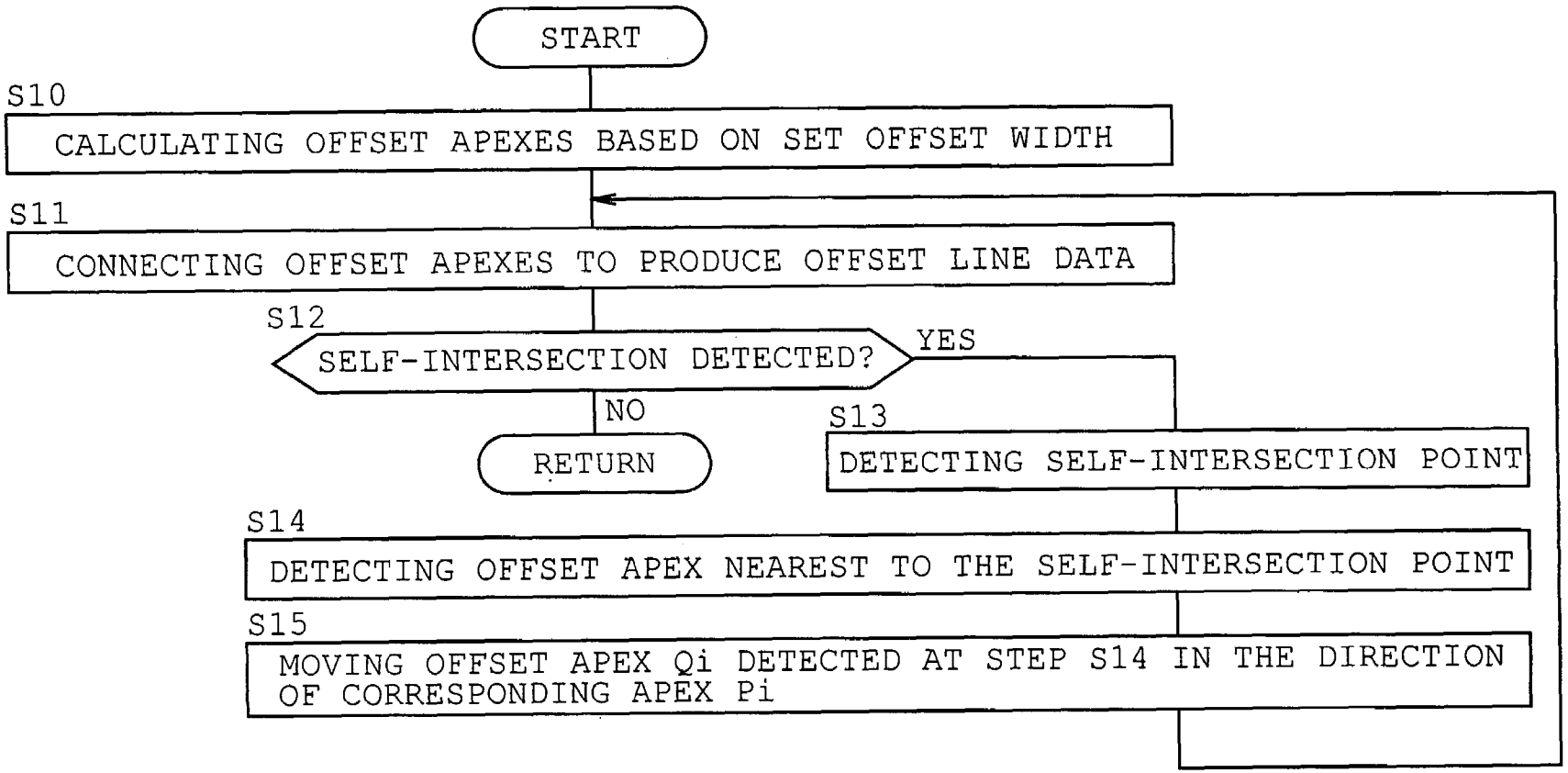
FIG. 4 is a flowchart showing a data producing routine of an offset line.

The operation of the embroidery data producing device 2 will now be described with reference to FIGS. 3 to 5C. FIG. 3 is a flowchart showing a main routine of an embroidery data producing program. FIG. 4 is a flowchart showing a data producing routine of an offset line in the main routine. The embroidery data producing program is executed by PC 25 of the embroidery data producing device 2. PC 25 reads in the outline 47 of the embroidery pattern 45 as shown in FIG. 5A in accordance with the embroidery data producing program. Based on the read outline 47, PC 25 produces embroidery data including data of underlying stitch sewing, data of embroidery stitch sewing and the like.

Figure 5B:
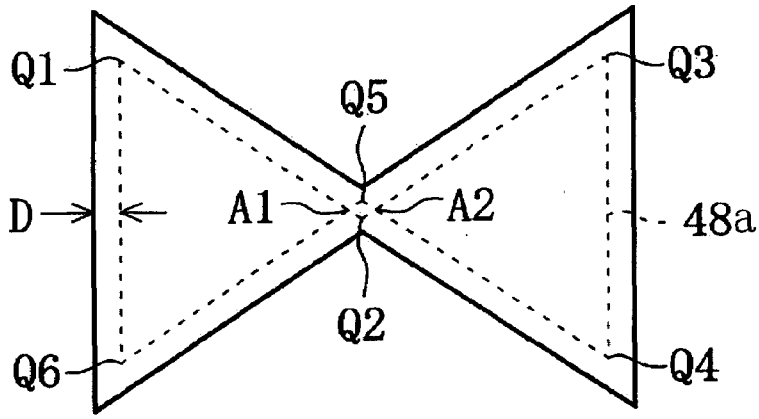
FIG. 5B shows an offset line self-intersecting.
Figure 5C:
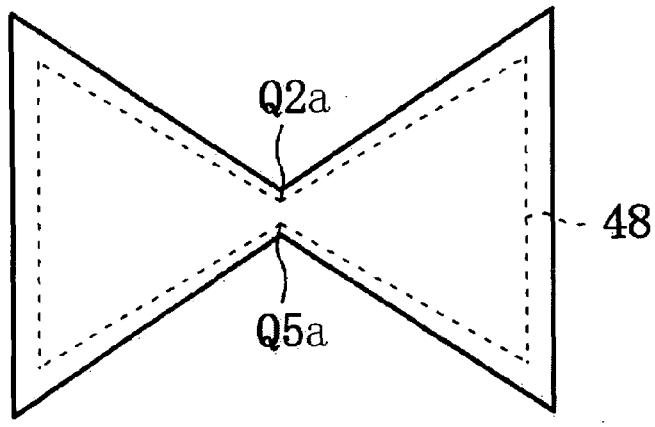
FIG. 5C shows an offset line in which self-intersection has been dissolved.

FIGS. 5A to 5C illustrate a process of producing data of an offset line 48 from data of the outline 47 of the embroidery pattern 45. The self intersection has been dissolved in data of the offset line 48. FIGS. 5A, 5B and 5C show the outline 47 of the embroidery pattern 47, a self-intersecting offset line 48*a* and the offset line 48 in which the self intersection has been dissolved, respectively.

A main routine as shown in FIG. 3 will firstly be described. PC 25 controls the image scanner 29 at step S1 so that the outline 47 of the embroidery pattern 45 is read in by the scanner from the original picture set on the scanner. At step S2, PC 25 carries out calculation to produce data of the outline 47 defining embroidery area 46. When the outline 47 of the embroidery pattern 45 of the original picture is a curved line, PC 25 converts the outline 47 to an angled line approximate to the curved line, thereby producing data of the outline 47.

PC 25 then advances to step S3 to produce data of the offset line 48 obtained by offsetting or moving the outline 47 inside. The process of producing data of the offset line 48 will be described later. PC 25 advances to step S4 to produce a plurality of underlying stitch sewing points on the offset line 48 and connects the underlying stitch sewing points to produce data of the underlying stitch sewing. At step S5, PC 25 produces a plurality of embroidery stitch sewing points on the outline 47 and connects the embroidery stitch sewing points to produce data of the embroidery stitch sewing.

Of the steps S1 to S5, step S1 includes the process of reading in the embroidery pattern. Step S2 includes the process of producing data of the outline 47. Step S5 includes the process of producing data of the embroidery stitch sewing. Since these processes are publicly known techniques, detailed description of each process will be eliminated.

Furthermore, data of the underlying stitch sewing is produced at step S4 for the purpose that sewing is carried out inside the produced offset line 48 at a lower thread density (2 mm per thread; and stitch pitch of 4 mm, for example) than the embroidery stitch sewing. In the process of producing the underlying stitch sewing data, the similar process of producing the underlying stitch sewing to that in the prior art as described above can be used except that the underlying stitch sewing data is produced on the basis of the offset line 48 produced by the offset line producing process at step S3. Accordingly, detailed description of the process will be eliminated.

The process of producing data of offset line 48 at step S3 will be described with reference to flowchart of FIG. 4. At step S10, PC 25 reads out offset width D (1 mm, for example) previously set and stored on HD 35 and offsets or moves the outline 47 defining the embroidery area 46 inside by the offset width D, thereby obtaining lines parallel to the outline 47. Subsequently, calculation is carried out so that offset apexes Q1 to Q6 corresponding to outline apexes P1 to P6 of the outline 47 respectively are obtained from points of intersection of the parallel lines. Furthermore, at step S11, the offset apexes Q1 to Q6 are connected to one another in the same order as the corresponding outline apexes P1 to P6, so that data of offset line 48*a* as shown in FIG. 5B is produced.

Subsequently, PC 25 advances to step S12 to determine whether the offset line 48*a* produced at steps S10 and S11 is self-intersecting. The self intersection here means a case where a part of the consecutive offset line 48*a* intersects another part of the line 48*a*. When determining that the offset line 48*a* is not self-intersecting (NO at step S12), PC 25 determines that data of the offset line 48*a* has been completed, returning to the main routine. On the other hand, when determining that the offset line 48*a* is self-intersecting (YES at step S12), PC 25 advances to step S13 to detect self-intersecting points A1 and A2, then advancing to step S14 to detect offset apexes Q2 and Q5 nearest to the self-intersecting points A1 and A2 respectively. When a plurality of offset apexes are located nearest to each self-intersecting point, all the offset apexes are to be detected.

At step S15, PC 25 obtains offset points obtained by moving the offset apexes Q2 and Q5 in the directions of the outline apexes P2 and P5 of the corresponding outline 47 by a predetermined width (0.1 mm, for example) so that the detected self intersection is dissolved. Thus, new offset apexes Q2*a* and Q5*a* are obtained. Thereafter, PC 25 advances to step S11 to produce new data of offset line 48*a* using the new offset apexes Q2*a* and Q5*a* and change the previous data to newly produced data. In the changed offset line 48*a*, the offset widths of the self-intersecting part and part near to the self-intersecting part have been reduced.

PC 25 repeats the processing at steps S11 to S15 until the self intersection has not been detected in the determination at step S12. FIG. 5C shows the state where the offset apexes Q2 and Q5 have been moved in the directions of outline apexes P2 and P5 by 0.1 mm from the state as shown in FIG. 5B such that the self-intersection has been dissolved. PC 25 returns to the main routine when data of offset line 48 in which the self intersection has been dissolved as shown in FIG. 5C has been produced. Accordingly, PC 25 can produce underlying stitch sewing data at step S4 of the main routine, based on data of the offset line 48 in which the self intersection has been dissolved.

As obvious from the foregoing, the embroidery data producing device 2 reduces the offset width D of the offset line 48*a* to produce the offset line 48 in which the self intersection has been dissolved when the offset line 48*a* is self-intersecting. Since the self intersection has been dissolved, the underlying stitch sewing data can be produced using a previously used process of producing data of underlying stitch sewing after the offset line 48 data has been produced. Consequently, the control of calculation for production of embroidery data can be simplified.

Furthermore, the self intersection can reliably be dissolved since the embroidery data producing device repeatedly carries out the data changing process until the self intersection is dissolved.

The underlying stitch sewing data is produced on the basis of the offset line 48 in which the self intersection has been dissolved. Accordingly, the offset lines 48 are prevented from overlapping even in a narrow area where a space between the opposed outlines 47 is narrow and a certain width can be obtained between the offset lines 48 proximate to each other. Consequently, work cloth can be reinforced by the underlying stitch sewing and can be prevented from shrinking during the embroidery stitch sewing. Furthermore, an embroidery pattern sewn by the embroidery stitch sewing can achieve a three-dimensional effect. Thus, the quality of embroidery sewing can be improved.

In the foregoing embodiment, the invention is applied to production of embroidery data including the underlying stitch sewing data produced on the basis of the offset line. However, the present invention can be applied to production of other embroidery data. For example, the invention can be applied to production of embroidery data including inside running stitch sewing data produced on the basis of the offset line, production of embroidery data including appliqué-related stitch sewing data or the like. The inside running stitch sewing data is sewing data setting a sewing order (a course in which a sewing needle is moved in the inner area) in the case where the running stitch sewing is carried out on or along the offset line 48. The inside running stitch sewing data is produced in order that the needle location may be moved to a predetermined sewing start location so that stitches can be sewn in the area inside the offset line by once of sewing without the stitches overlapping. Furthermore, the appliqué-related stitch sewing data is the stitch data on which an appliqué cloth piece is sewn onto work cloth or sewing data on which stitches of positioning line indicative of a sewing location of appliqué cloth piece onto work cloth when the appliqué cloth piece is sewn onto the work cloth.

When an inside running stitch sewing data is produced on the basis of the self-intersecting offset line, a needle drop position is concentrated onto the self-intersection such that work cloth is swollen, whereupon the inside running stitches disadvantageously become excessively conspicuous. In the embodiment, however, sewing data for the inside running stitch sewing is produced on the basis of the offset line in which the self intersection has been dissolved. Consequently, the foregoing disadvantage that the inside running stitches become excessively conspicuous can be overcome.

Furthermore, when appliqué-related stitch sewing data is produced on the basis of the offset line in which the self intersection has been dissolved, appliqué stitches sewn inside the appliqué cloth can be prevented from overlapping even in a narrow area. Consequently, quality of sewn products can be improved.

FIGS. 6 to 8C illustrate a second embodiment of the invention. The invention is applied to an embroidery data producing device for producing embroidery data including the inside running stitch sewing. The embroidery data producing device of the embodiment is arranged to dissolve mutual intersection that an offset line intersects the outline when the offset line is produced for the inside running stitch sewing. An embroidering and sewing machine connected to the embroidery data producing device is similar to that in the first embodiment and accordingly, the description of the embroidering and sewing machine will be eliminated.

Figure 6:
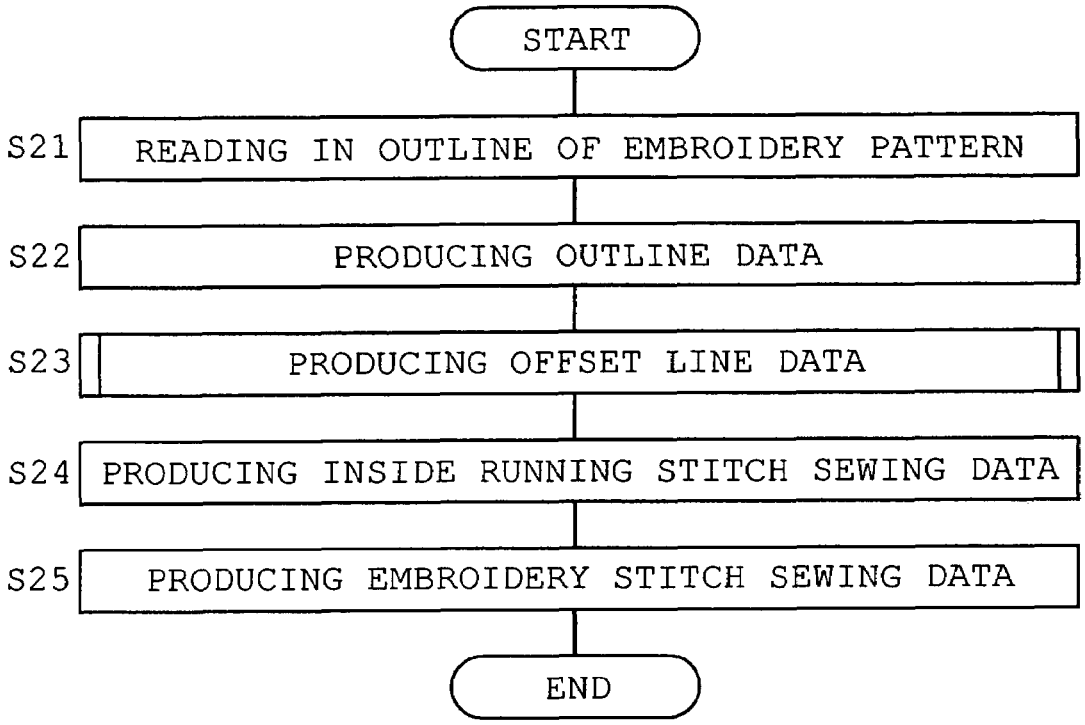
FIG. 6 is a flowchart similar to FIG. 3, showing a second embodiment of the invention.
Figure 7:
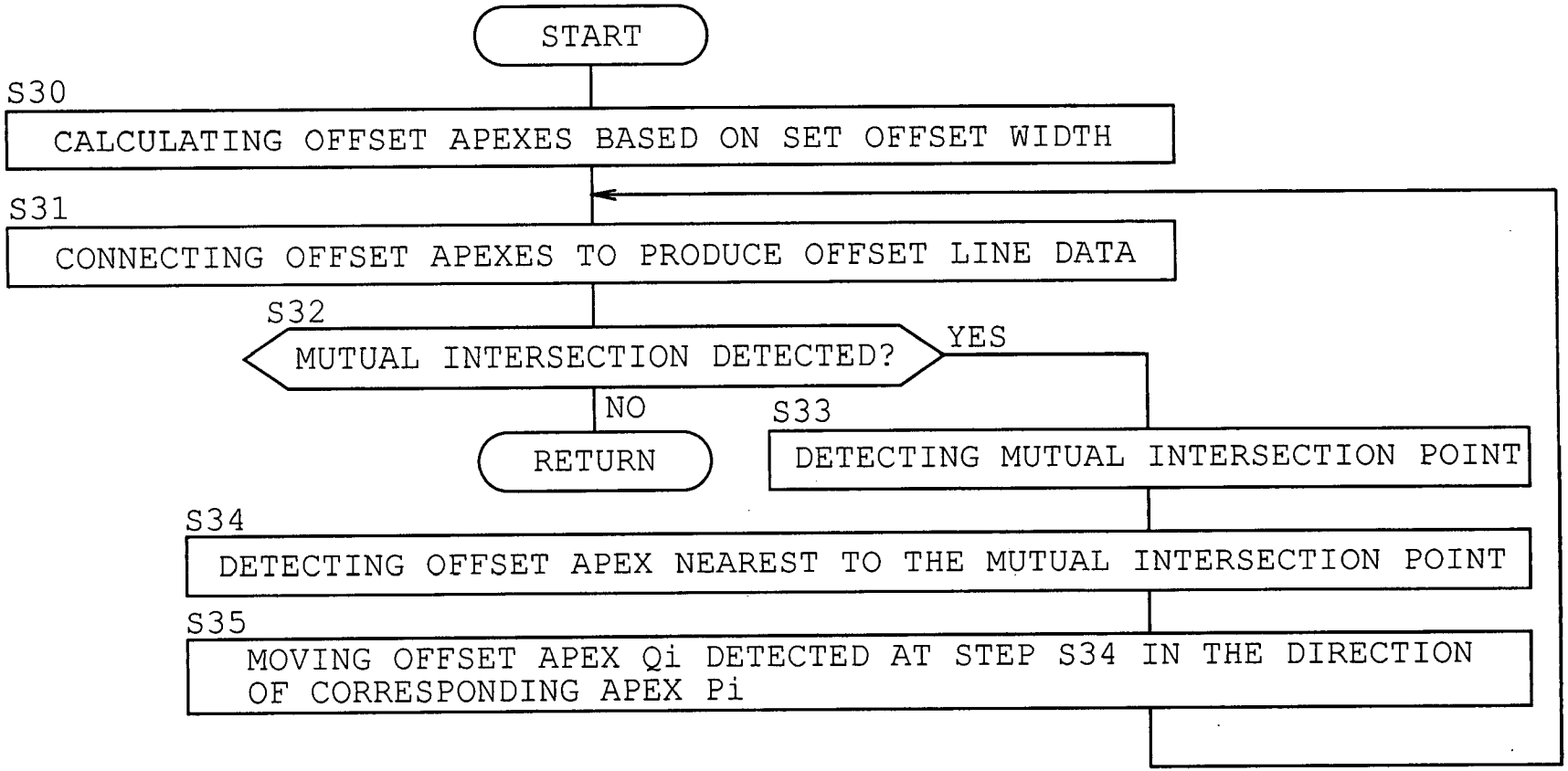
FIG. 7 is a flowchart similar to FIG. 4.

FIG. 6 is a flowchart showing the main routine of the embroidery data producing program. FIG. 7 is a flowchart showing an offset line data producing routine in the main routine. The outline reading process at step S21 in FIG. 6 is the same as step S1 in FIG. 3. The outline data producing process at step S22 in FIG. 6 is the same as step S2 in FIG. 3. The embroidery stitch sewing data producing process at step S25 is the same as step S5 in FIG. 3. Furthermore, at step S23, mutual intersection is dissolved and data of offset line 52 is produced. At step S24, data of inside running stitch sewing is produced using a part of the offset line 52 in which mutual intersection has been dissolved. Since the processes at respective steps S21, S22, S24 and S25 are publicly known techniques, detailed description of each process will be eliminated.

Figure 8A:
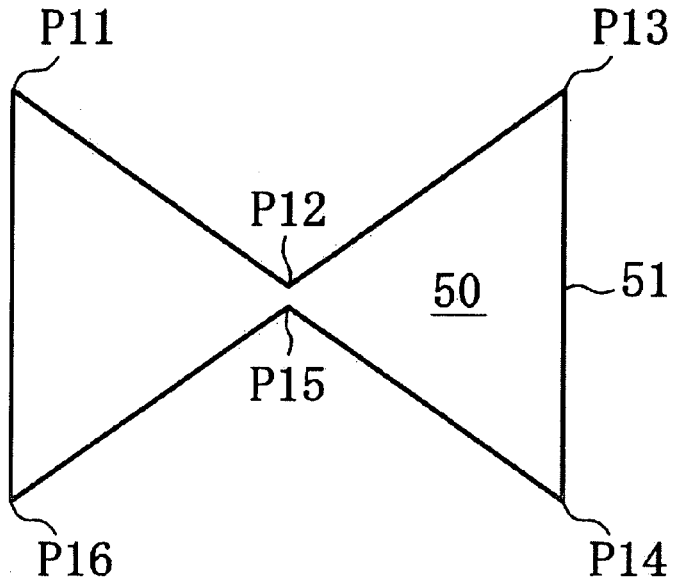
FIG. 8A shows an outline of an embroidery pattern.
Figure 8B:
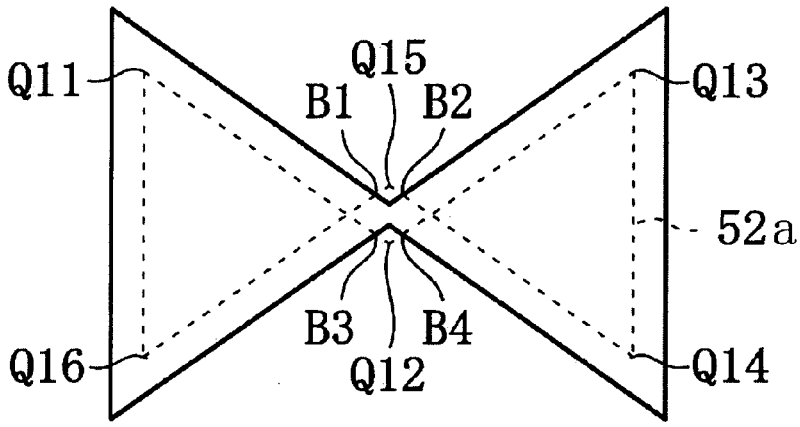
FIG. 8B shows an offset line mutually intersecting.
Figure 8C:
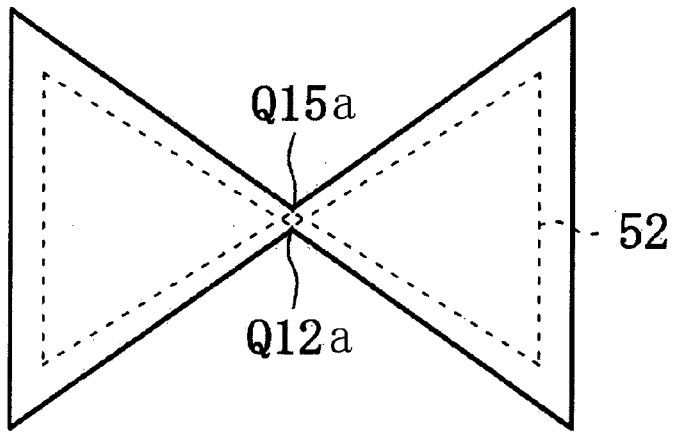
FIG. 8C shows an offset line in which mutual intersection has been dissolved.

FIGS. 8A to 8C show a process of producing data of offset line 52 in which mutual intersection has been dissolved, from data of outline 51 of an embroidery pattern 50 by execution of the embroidery data producing program. FIG. 8A shows the outline 51 of the embroidery pattern. FIG. 8B shows a mutually intersecting offset line 52*a*. FIG. 8C shows the offset line 52 in which the mutual intersection has been dissolved.

The process of producing data of offset line 52 at step S23 will be described with reference to flowchart of FIG. 7. At step S30, PC 25 carries out calculation process using the previously set offset width D to obtain offset apexes Q11 to Q16 corresponding to outline apexes P11 to P16 of the outline 51 defining the embroidery area 50, respectively, as at step S10 in FIG. 4. Furthermore, at step S31, the offset apexes Q11 to Q16 are connected to one another so that data of offset line 52*a* is produced, as at step S11 in FIG. 4.

Subsequently, PC 25 advances to step S32 to determine whether a part of the consecutive offset line 52*a* produced at steps S30 and S31 is mutually intersecting the outline 51. When determining that the offset line 52*a* is not mutually intersecting the outline 51 (NO at step S32), PC 25 determines that data of the offset line 52*a* has been completed, returning to the main routine. On the other hand, when determining that the offset line 52*a* is mutually intersecting the outline 51 (YES at step S32), PC 25 advances to step S33 to detect mutually intersecting points B1 to B4, then advancing to step S34 to detect offset apexes Q12 and Q15 nearest to the mutually intersecting points B1 to B4 respectively.

At step S35, PC 25 obtains offset points obtained by moving the offset apexes Q12 and Q15 in the directions of the outline apexes P12 and P15 of the corresponding outline 51 by a predetermined width (0.1 mm, for example) so that the detected mutual intersection is dissolved. Thus, new offset apexes Q12*a* and Q15*a* are obtained. Thereafter, PC 25 advances to step S31 to produce new data of offset line 52*a* using the new offset apexes Q12*a* and Q15*a* and change the previous data to newly produced data. In the changed offset line 52*a*, the offset widths of the mutually intersecting part and part near to the mutually intersecting part have been reduced.

PC 25 repeats the processing at steps S31 to S35 until the mutual intersection has not been detected in the determination at step S32. FIG. 8C shows the state where the offset apexes Q12 and Q15 have been moved in the directions of outline apexes P12 and P15 by 0.1 mm from the state as shown in FIG. 8B such that the mutual intersection has been dissolved. PC 25 returns to the main routine when data of offset line 52 in which the mutual intersection has been dissolved as shown in FIG. 8C has been produced. Accordingly, PC 25 can produce inside running stitch sewing data at step S24 of the main routine, based on data of the offset line 52 in which the mutual intersection has been dissolved.

As obvious from the foregoing, the embroidery data producing device 2 reduces the offset width D of the offset line 52*a* to produce the offset line 52 in which the mutual intersection has been dissolved when the offset line 52*a* is mutually intersecting the outline 51. Since the mutual intersection has been dissolved, the inside running stitch sewing data can be produced using a previously used process of producing data of inside running stitch sewing after the offset line 52 data has been produced. Consequently, the control of calculation for production of embroidery data can be simplified.

Furthermore, the mutual intersection can reliably be dissolved since the embroidery data producing device 2 repeatedly carries out the data changing process until the mutual intersection is dissolved.

Furthermore, since the inside running stitch sewing data is produced on the basis of the offset line 52 in which the mutual intersection has been dissolved, the inside running stitches can be prevented from being sewn outside the outline 51 and accordingly, the quality of sewn product can be improved.

Figure 9:
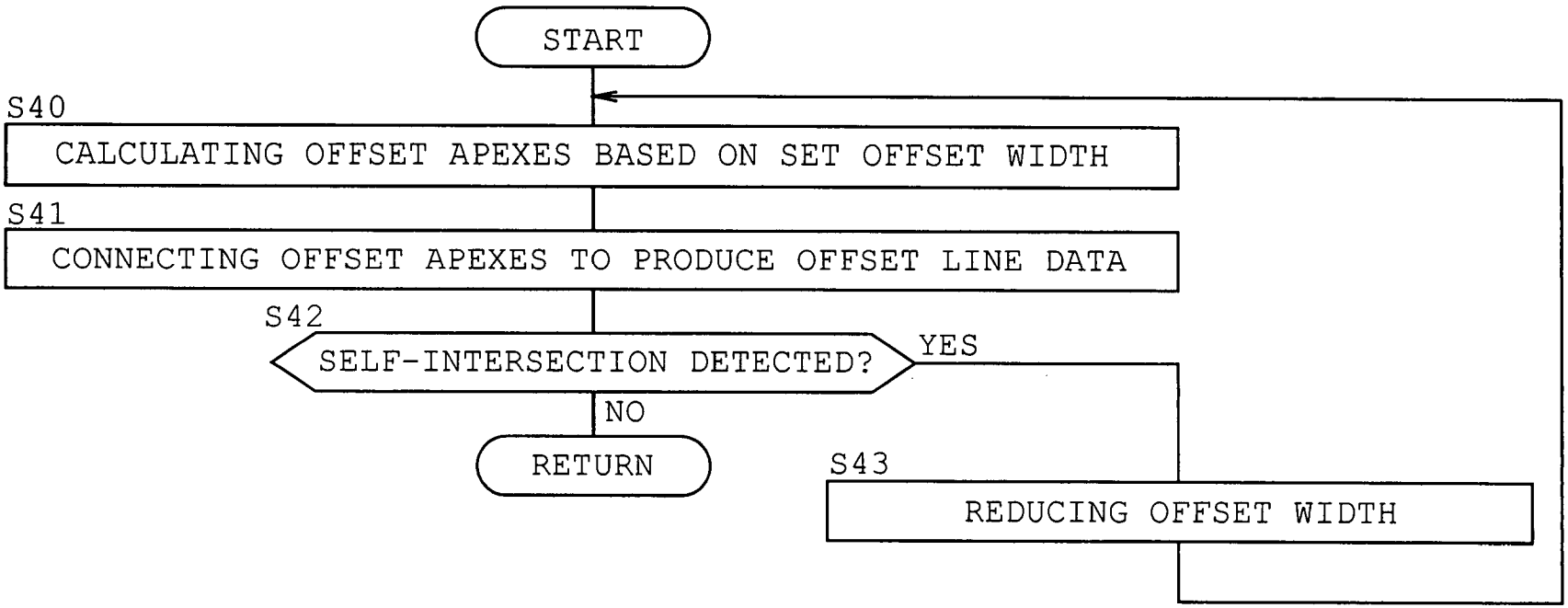
FIG. 9 is a flowchart similar to FIG. 4, showing a third embodiment of the invention.
Figure 10:
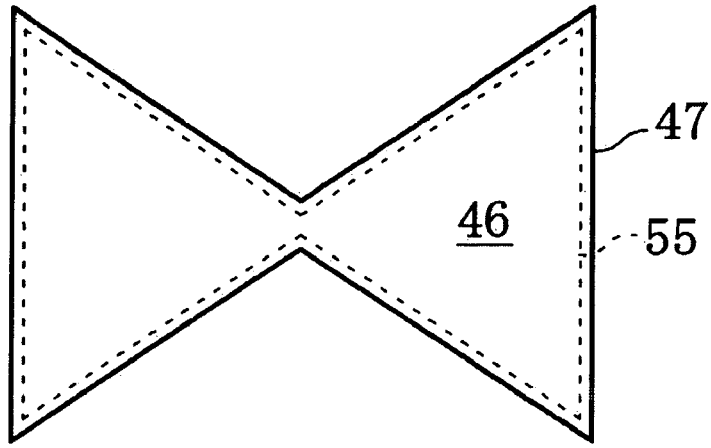
FIG. 10 is a view similar to FIG. 5C.

FIGS. 9 and 10 illustrate a third embodiment of the invention. In the third embodiment, the self-intersection or mutual intersection is dissolved and the offset line data is changed in a manner differing from that in the first or second embodiment. FIG. 9 is a flowchart showing the routine for producing data of offset line in which self-intersection has been dissolved. FIG. 10 shows the offset line 55 obtained after the self-intersection has been dissolved in the state with the self-intersection as shown in FIG. 5B.

At steps S40 and S41, PC 25 carries out the calculation process using the previously set offset width D to obtain offset apexes Q1 to Q6 as at steps S10 and S11 in FIG. 4. The offset apexes Q1 to Q6 are connected to one another so that data of offset line 48*a* is produced (see FIG. 5B). Subsequently, PC 25 advances to step S42 to determine whether a part of the offset line 48*a* is self-intersecting. When determining that the offset line 48*a* is not self-intersecting (NO at step S42), PC 25 determines that data of the offset line 55 has been completed (see FIG. 10), returning to the main routine. On the other hand, when determining that the offset line 48*a* is self-intersecting (YES at step S42), PC 25 advances to step S43 to reduce the offset width D by a predetermined width over the whole offset line 48*a*.

Subsequently, PC 25 carries out the calculation process using the newly set offset width D at steps S40 and S41 to obtain the offset apexes Q1, Q2, and . . . , producing data of offset line 55. PC 25 repeats the processing at steps S40 to S43 until the self-intersection has not been detected in the determination at step S42. PC 25 returns to the main routine when data of offset line 55 in which the self-intersection has been dissolved as shown in FIG. 10 has been produced. On the other hand, in order that the mutual intersection may be dissolved, PC 25 is just arranged to detect the mutual intersection at step S42 and the flowchart for this routine will be eliminated.

In the third embodiment, the offset width D is reduced over the whole offset line 55. Accordingly, PC 25 can produce data of offset line 55 obtained by offsetting or moving the outline 47 inside the embroidery area 46 by a constant offset width over the whole offset line 55. In this case, too, the control of calculation for production of embroidery data can be simplified as in the first and second embodiments.

Figure 11:
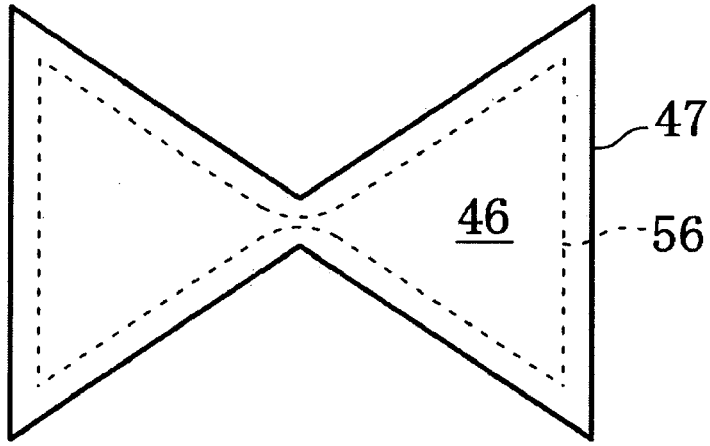
FIG. 11 is a view similar to FIG. 5C, showing a fourth embodiment of the invention.

FIG. 11 illustrates a fourth embodiment of the invention. In the previous embodiments, the offset width D is reduced so that the self-intersection or mutual intersection is dissolved. In the fourth embodiment, however, the shape of offset line near the portion of the self-intersection or mutual intersection is changed so that the offset line is changed, whereupon the self-intersection or mutual intersection is dissolved.

More specifically, when the offset line 48*a* is self-intersecting as shown in FIG. 5B, a part of the offset line 48*a* near the self-intersecting portion is curved so that the data of offset line 56 is changed, whereby the self-intersection is dissolved. Furthermore, a part of the offset line near the self-intersecting portion or mutual intersecting portion may be deformed into the shape of an angled line instead of curve. Consequently, since data of only the part of offset line near the portion of self-intersection or mutual intersection is changed, the control of calculation for production of offset line data can be simplified.

The present invention should not be limited to the foregoing embodiments. The embodiments may be modified or expanded as follows. In the first and second embodiments, only the offset point nearest to the self-intersection or mutual intersection is moved in the direction of the apex. However, all the offset points located a predetermined distance away from the self-intersection or mutual intersection may be moved to the apex side, instead. Furthermore, all the offset points located between two intersections may be moved to the apex side.

In order that the self-intersection or mutual intersection may be dissolved, the offset width may be reduced at a predetermined rate for a previously set offset width, other than reducing the offset width by a predetermined amount.

The foregoing description and drawings are merely illustrative of the principles of the present invention and are not to be construed in a limiting sense. Various changes and modifications will become apparent to those of ordinary skill in the art. All such changes and modifications are seen to fall within the scope of the invention as defined by the appended claims.

What is claimed is:

1. An embroidery data producing device comprising:

offset line producing means for producing data of an offset line obtained by offsetting an outline defining an embroidery area inside an embroidery area by a previously set offset width, based on data of the outline defining the embroidery area;

self-intersection detecting means for detecting a self-intersection of the offset line produced by the offset line producing means; and offset line changing means for changing the offset line data produced by the offset line producing means upon detection of a self-intersection by the self-intersection detecting means so that the self-intersection is dissolved.

2. The embroidery data producing device according to claim 1, wherein the offset line changing means reduces an offset width of at least a part of the offset line so that the self-intersection detected by the self-intersection detecting means is dissolved, the offset line changing means changing the offset line data using the reduced offset width.

3. The embroidery data producing device according to claim 1, wherein the offset line changing means reduces offset widths of a self-intersecting portion of the offset line produced by the offset line producing means and a portion near the self-intersecting portion respectively, thereby changing the offset line data.

4. The embroidery data producing device according to claim 1, wherein the offset line changing means reduces the offset width over a whole offset line produced by the offset line producing means, thereby changing the offset line data.

5. The embroidery data producing device according to claim 1, wherein the offset line changing means reduces the offset width by a predetermined amount, thereby changing the offset line data produced by the offset line producing means.

6. The embroidery data producing device according to claim 1, wherein the offset line changing means reduces the offset width at a predetermined rate, thereby changing the offset line data produced by the offset line producing means.

7. The embroidery data producing device according to claim 1, wherein the offset line changing means deforms a configuration of the offset line near a self-intersecting portion of the offset line produced by the offset line producing means, thereby changing the offset line data produced by the offset line producing means.

8. The embroidery data producing device according to claim 1, further comprising data producing means for producing at least one of underlying stitch sewing data, inside running stitch sewing data and appliqué-related sewing data all contained in an embroidery data, based on the offset line data changed by the offset line changing means.

9. An embroidery data producing device comprising:

offset line producing means for producing data of an offset line obtained by offsetting an outline defining an embroidery area inside an embroidery area by a previously set offset width, based on data of the outline defining the embroidery area;

mutual intersection detecting means for detecting a mutual intersection of the offset line produced by the offset line producing means and the outline; and offset line changing means for changing the offset line data produced by the offset line producing means upon detection of a mutual intersection by the mutual intersection detecting means so that the mutual intersection is dissolved.

10. The embroidery data producing device according to claim 9, wherein the offset line changing means reduces an offset width of at least a part of the offset line so that the mutual intersection detected by the mutual intersection detecting means is dissolved, the offset line changing means changing the offset line data using the reduced offset width.

11. The embroidery data producing device according to claim 9, wherein the offset line changing means reduces offset widths of a mutually intersecting portion of the offset line produced by the offset line producing means and the outline and a portion near the mutual intersecting portion respectively, thereby changing the offset line data.

12. The embroidery data producing device according to claim 9, wherein the offset line changing means reduces the offset width over a whole offset line produced by the offset line producing means, thereby changing the offset line data.

13. The embroidery data producing device according to claim 9, wherein the offset line changing means reduces the offset width by a predetermined amount, thereby changing the offset line data produced by the offset line producing means.

14. The embroidery data producing device according to claim 9, wherein the offset line changing means reduces the offset width at a predetermined rate, thereby changing the offset line data produced by the offset line producing means.

15. The embroidery data producing device according to claim 9, wherein the offset line changing means deforms a configuration of the offset line near a mutual intersecting portion of the offset line produced by the offset line producing means and the outline, thereby changing the offset line data produced by the offset line producing means.

16. The embroidery data producing device according to claim 9, further comprising data producing means for producing at least one of underlying stitch sewing data, inside running stitch sewing data contained in an embroidery data, based on the offset line data changed by the offset line changing means.

17. An embroidery data producing program which is stored on a computer-readable medium and on which a computer constituting an embroidery data producing device executes the following routines comprising:

a first routine producing data of an offset line obtained by offsetting an outline defining an embroidery area inside an embroidery area by a previously set offset width, based on data of the outline defining the embroidery area;

a second routine detecting a self-intersection of the offset line; and a third routine changing the offset line data upon detection of a self-intersection by the second routine so that the self-intersection is dissolved.

18. The embroidery data producing program according to claim 17, wherein the third routine reduces an offset width of at least a part of the offset line, the third routine changing the offset line data using the reduced offset width.

19. The embroidery data producing program according to claim 18, further comprising a fourth routine carrying out the second and third routines repeatedly at a plurality of times until the self-intersection is dissolved.

20. An embroidery data producing program which is stored on a computer-readable medium and on which a computer constituting an embroidery data producing device executes the following routines comprising:

a first routine producing data of an offset line obtained by offsetting an outline defining an embroidery area inside an embroidery area by a previously set offset width, based on data of the outline defining the embroidery area;

a second routine detecting a mutual intersection of the offset line and the outline; and a third routine changing the offset line data upon detection of a mutual intersection by the second routine so that the mutual intersection is dissolved.

21. The embroidery data producing program according to claim 20, wherein the third routine reduces an offset width of at least a part of the offset line, the third routine changing the offset line data using the reduced offset width.

22. The embroidery data producing program according to claim 21, further comprising a fourth routine carrying out the second and third routines repeatedly at a plurality of times until the mutual intersection is dissolved.

* * * * *